US007895843B1

(12) United States Patent
Hawkins et al.

(10) Patent No.: US 7,895,843 B1
(45) Date of Patent: Mar. 1, 2011

(54) REFRIGERATOR WITH ONE PIECE FAN MOTOR MOUNT

(75) Inventors: Trevor L. Hawkins, Belle Plaine, IA (US); Derek T. Lehman, Coralville, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/627,488

(22) Filed: Nov. 30, 2009

(51) Int. Cl.
*F25C 1/00* (2006.01)

(52) U.S. Cl. ..... 62/66; 62/340

(58) Field of Classification Search ..... 62/66, 259.1, 62/298, 340, 419, 314, 414; 165/120, 121, 165/80.2, 80.3; 361/695, 696, 704; 415/140, 415/189, 190; 417/423.1, 423.15; 454/200, 454/204; 248/640, 674
See application file for complete search history.

(56) References Cited

U.S. PATENT DOCUMENTS 4,649,717 A 3/1987 Tate, Jr. et al.
4,799,362 A 1/1989 Chestnut
5,160,094 A 11/1992 Willis et al.
5,533,705 A * 7/1996 Zlotnik et al. ..... 248/645
5,590,025 A 12/1996 Clemens
5,677,829 A 10/1997 Clemens
5,724,228 A 3/1998 Lee
5,943,209 A 8/1999 Liu
6,017,185 A 1/2000 Kuo
6,118,657 A 9/2000 Clemens
6,232,687 B1 5/2001 Hollenbeck et al.
6,271,609 B1 8/2001 Hollenbeck et al.
6,286,324 B1 * 9/2001 Pastryk et al. ..... 62/137
6,302,189 B1 10/2001 Lin et al.
6,309,190 B1 * 10/2001 Chen ..... 417/423.1
6,311,766 B1 * 11/2001 Lin et al. ..... 165/80.3
6,343,013 B1 1/2002 Chen
6,407,920 B1 6/2002 Jui-Yuan et al.
6,438,988 B1 8/2002 Paskey
6,508,300 B1 1/2003 Hegde
6,520,250 B2 2/2003 Lee et al.
6,547,540 B1 * 4/2003 Horng et al. ..... 417/423.14
6,672,374 B1 * 1/2004 Lin ..... 165/121
6,822,864 B2 11/2004 Huang et al.
7,004,236 B2 2/2006 Lee et al.
7,017,364 B2 * 3/2006 Lee et al. ..... 62/351
7,038,913 B2 5/2006 Lee et al.
7,139,171 B2 11/2006 Wang et al.
7,221,567 B2 * 5/2007 Otsuki et al. ..... 361/695
7,259,487 B2 8/2007 Mullin et al.
7,263,854 B2 * 9/2007 Lee et al. ..... 62/351
7,369,408 B2 5/2008 Chang (Continued)

*Primary Examiner* — Mohammad M Ali
(74) *Attorney, Agent, or Firm* — Kirk W. Goodwin; McKee, Voorhees & Sease PLC

(57) ABSTRACT

A refrigerator includes a refrigerator cabinet, a freezer compartment, a fresh food compartment, a door providing access to the refrigerator, and an ice making compartment. The ice making compartment includes an assembly including a fan, bracket, grommet, and motor. The bracket is configured to receive the grommet, fan, and motor without separate securing means. A method of manufacturing a refrigerator includes providing a refrigerator with an ice making compartment and an assembly consisting of a fan, bracket, grommet, and motor. The fan, grommet, and motor are attached to the bracket through the use of latches, which hold the components in place. The assembly is then installed into the ice making compartment, such that the fan assists in cooling the ice making compartment.

25 Claims, 6 Drawing Sheets

U.S. PATENT DOCUMENTS

| | | | | |
|---|---|---|---|---|
| 7,405,934 | B2 * | 7/2008 | Otsuki et al. | 361/697 |
| 7,437,885 | B2 * | 10/2008 | Wu et al. | 62/344 |
| 7,659,648 | B2 * | 2/2010 | Brown | 310/90 |
| 2004/0007010 | A1 | 1/2004 | Kopf et al. | |
| 2005/0095121 | A1 | 5/2005 | Vithani | |
| 2006/0126302 | A1 | 6/2006 | Lee et al. | |
| 2008/0087025 | A1 | 4/2008 | McCain et al. | |

* cited by examiner

REFRIGERATOR WITH ONE PIECE FAN MOTOR MOUNT

FIELD OF THE INVENTION

The present invention relates to the field of refrigerators. More specifically, but not exclusively, the present invention provides a compact way to secure a fan motor and shaft vertically in an ice box enclosure of a refrigerator.

BACKGROUND OF THE INVENTION

The greater need in the space available in refrigerators and ice boxes has brought along a need to make the components of the refrigerators and ice boxes smaller and capable of fitting into less space. This includes such items as brackets and other devices, which are used to hold and secure fans and motors in ice box enclosures and evaporators. In the past, people have used a bracket, two grommets, and a clip sandwiching the motor between the grommets, bracket, and clip. However, this creates problems.

The multiple components may be difficult to assemble, and it may be time consuming to assemble. The components are small and it is difficult to put the fan, bracket, grommet, and motor assemblies together, while also making sure that they do not take up much room in the ice boxes and evaporators. At the same time, people have been wanting more space in their refrigerators, thus increasing the difficulty. Securing a small assembly containing multiple parts into a small opening can be very difficult and time consuming. This is especially true when separate fasteners are used to secure the parts in place.

Therefore, what is needed is a method and apparatus for an ice box of a refrigerator which reduces the number of parts used in mounting a fan and motor assembly.

BRIEF SUMMARY OF THE INVENTION

Therefore, the present invention provides for a one piece fan motor mount bracket in which the fan and motor may be attached to an ice box in a refrigerator without separate fasteners.

According to one aspect of the invention, a refrigerator is provided. The refrigerator includes a refrigerator cabinet, a freezer compartment disposed within the refrigerator cabinet, a fresh food compartment disposed within the refrigerator cabinet, a door providing access to the fresh food compartment, an ice making compartment in the refrigerator cabinet, an assembly associated with the ice making compartment including a fan and a motor, and a bracket. The bracket includes a first face containing a plurality of latches extending therefrom, a second face opposite the first face, and a hole extending from the first face to the second face.

According to another aspect of the invention, a method of manufacturing a refrigerator is provided. The method includes providing a refrigerator cabinet, a door providing access to the cabinet, an ice making compartment, and a bracket. A fan may be attached to the bracket, and a motor may be attached to the other side of the bracket, wherein latches snap the motor into place. The shaft of the motor may be connected to the fan, and the bracket may be installed into the refrigerator, such that the fan assists in cooling the ice making compartment.

According to another aspect of the invention, a refrigerator is provided. The refrigerator includes a refrigerator cabinet, a freezer compartment disposed within the refrigerator cabinet, a fresh food compartment disposed within the refrigerator cabinet, a door providing access to the fresh food compartment, an ice making compartment in the refrigerator cabinet, an assembly associated with the ice making compartment including a fan and a motor, and a bracket. The bracket includes a first face containing a plurality of latches extending therefrom, a second face opposite the first face, a hole extending from the first face to the second face, and a post extending from the first face to align and stabilize the motor. A grommet is included in the hole of the bracket to engage a shaft of the motor to create an airtight seal.

According to another aspect of the invention, an ice box is provided. The ice box includes an ice making compartment, an assembly associated with the ice making compartment including a fan and a motor, and a bracket. The bracket includes a first face containing a plurality of latches extending therefrom, a second face opposite the first face, and a hole extending from the first face to the second face.

DETAILED DESCRIPTION OF THE PREFERRED EMBODIMENTS

Although the present invention is described with respect to various embodiments, the present invention is not to be limited to the specific embodiments described herein. It is further to be understood that no single embodiment of the present invention need have all the structures or perform all the functions associated with any particular aspect or embodiment of the invention.

Figure 1:
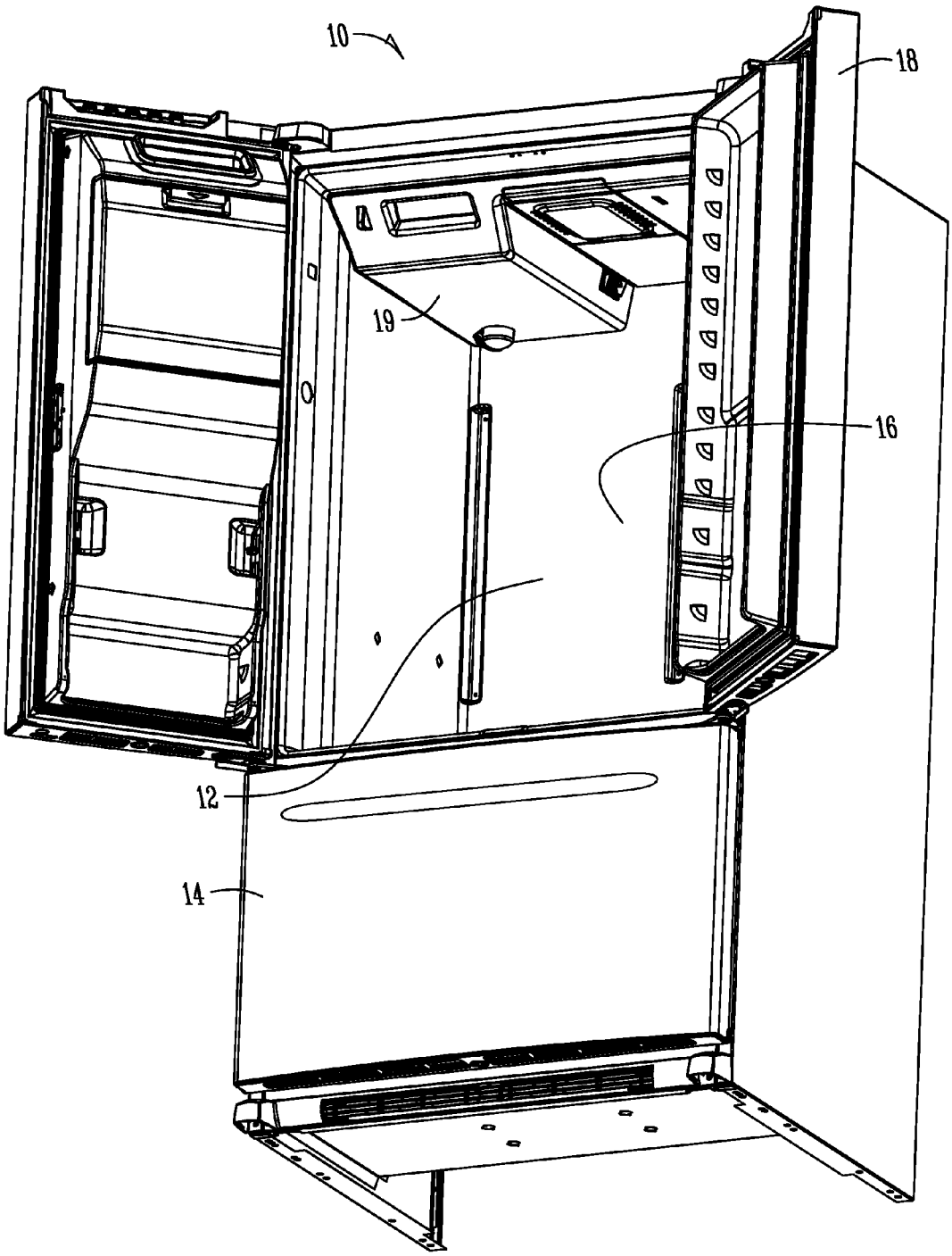
FIG. 1 is a perspective view showing one embodiment of a refrigerator with an ice making compartment.

FIG. 1 is a perspective view showing one embodiment of a refrigerator with an ice making compartment. The refrigerator 10 includes a refrigerator cabinet 12. The cabinet 12 is an insulated cabinet. The refrigerator 10 further includes a door 18 which provides access to a fresh food compartment 16, which is disposed within the refrigerator cabinet 12. A freezer compartment 14 may also be found disposed within the refrigerator cabinet 12. An ice making compartment 19 may be found in the refrigerator cabinet 12, as well.

Figure 2:
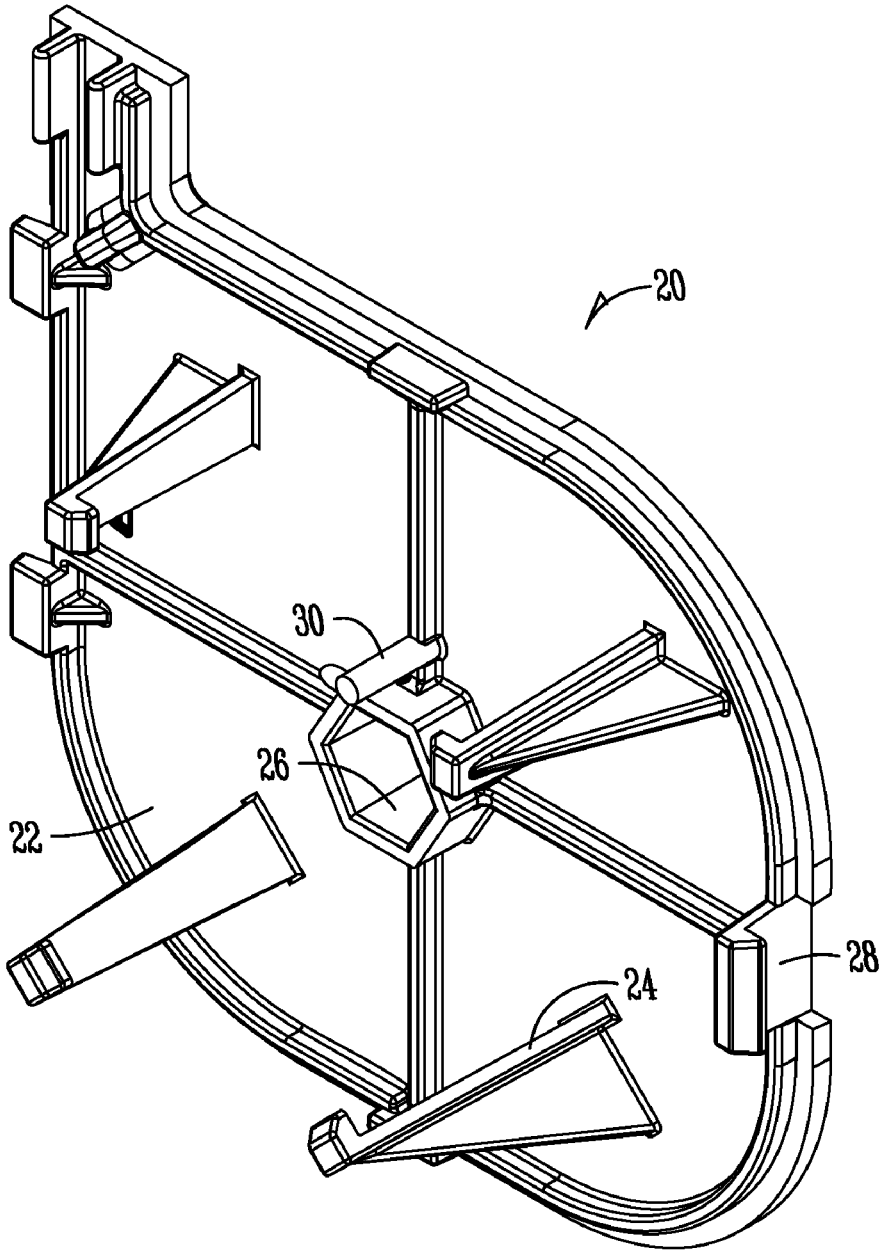
FIG. 2 is a perspective view showing one embodiment of the bracket of the present invention.

FIG. 2 is a perspective view showing one embodiment of a bracket 20 of the present invention, which may be found in the ice making compartment 19 of the refrigerator 10. The bracket 20 contains a first face 22 which has a plurality of latches 24 extending therefrom. FIG. 2 also shows that the bracket 20 contains a hole 26 which extends through the middle of the first face 22. A post 30 extends from the first face 22 of bracket 20. Additionally, on the first face 22 of the bracket 20 there are a plurality of securing means. The securing means 28 may be secondary latches or tool removable snap features or another means of securing the bracket at the ice making compartment 19.

Figure 3:
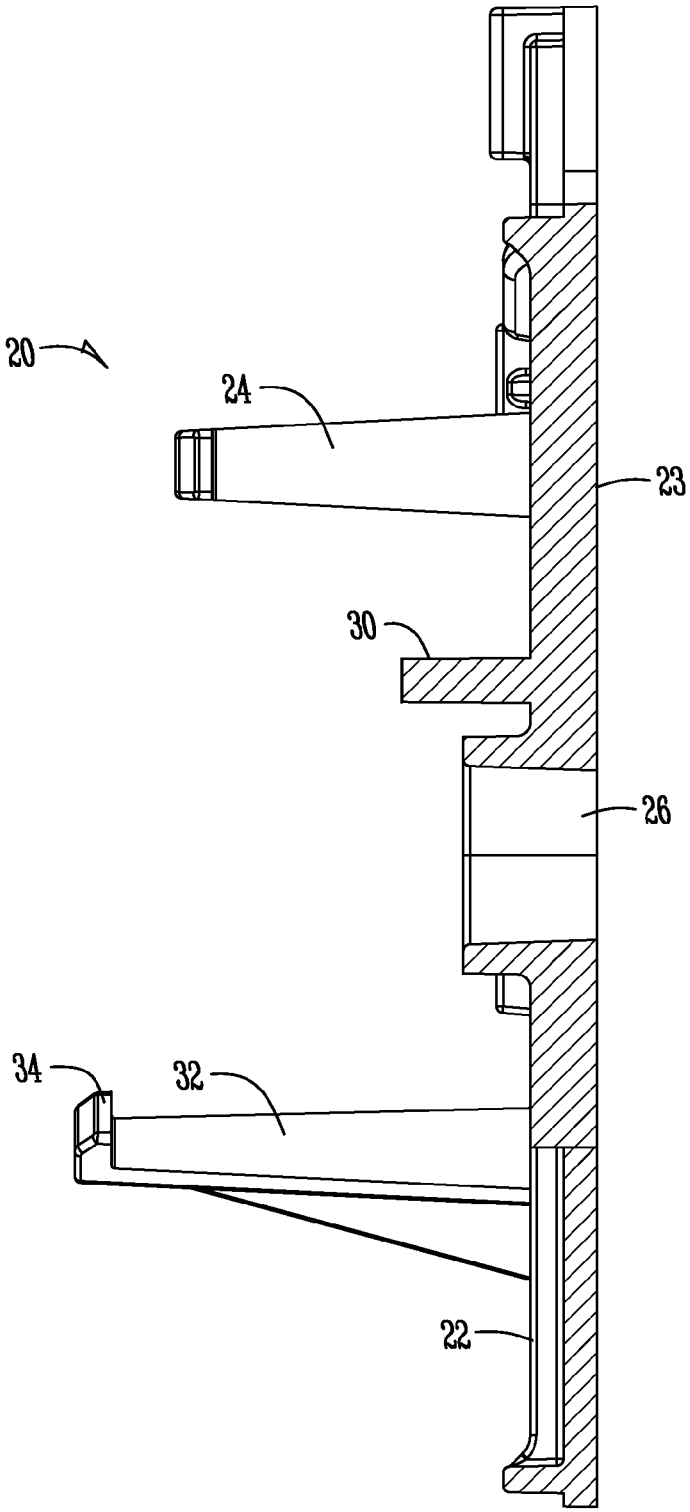
FIG. 3 is a cross-sectional view of one embodiment of the bracket of the present invention.

FIG. 3 shows a cross sectional view of one embodiment of the bracket 20. As seen in FIG. 3, the latches 24 each contain a stem 32 extending from the first face 22 of the bracket 20 and further contain a lip 34 extending away from the stem 32. Additionally, as seen in FIG. 3, opposite first face 22 is a second face 23. Also, the hole 26 extends through the first face 22 and the second face 23.

Figure 4:
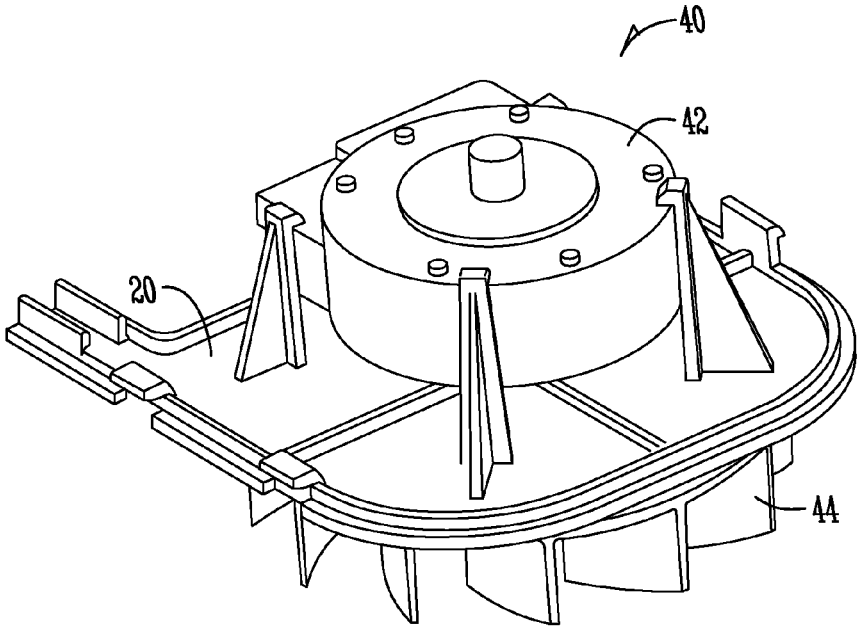
FIG. 4 is a perspective view of one embodiment of the fan, bracket, grommet, and motor assembly of the present invention.

FIG. 4 shows a perspective view of one embodiment of an assembly 40 containing a fan 44, a bracket 20, a motor 42, and a grommet 46. As seen in FIG. 4, the motor 42 attaches to the bracket 20 at the first face 22 and the fan 44 attaches to the bracket on the second face 23. Also seen in FIG. 4, the lips 34 of the latches 24 clamp down on the motor 42, thus holding the motor 42 in place.

Figure 5:
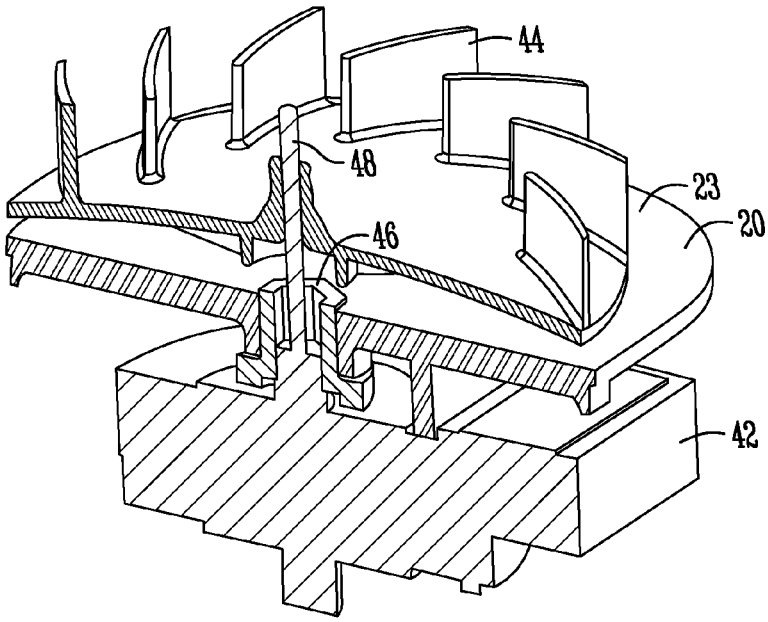
FIG. 5 is a cross-sectional view of the assembly of FIG. 4.

FIG. 5 shows a cross sectional view of the assembly of FIG. 4. As seen in FIG. 5, the grommet 46 may be inserted through the hole 26 of the bracket 20. The shaft 48 of the motor 42 is inserted through the first face 22 of the bracket 20, through the grommet 46, through the second face 23 of the bracket 20, and finally through the fan 44. The grommet 46 and the shaft of the motor 48 engagingly connect so to create an airtight seal between the two, which reduces noise and vibration. Also, as seen in FIG. 5, the fan 44 attaches to the assembly 40 at the second face 23 of the bracket 20 without use of separate fasteners or external fasteners.

Figure 6:
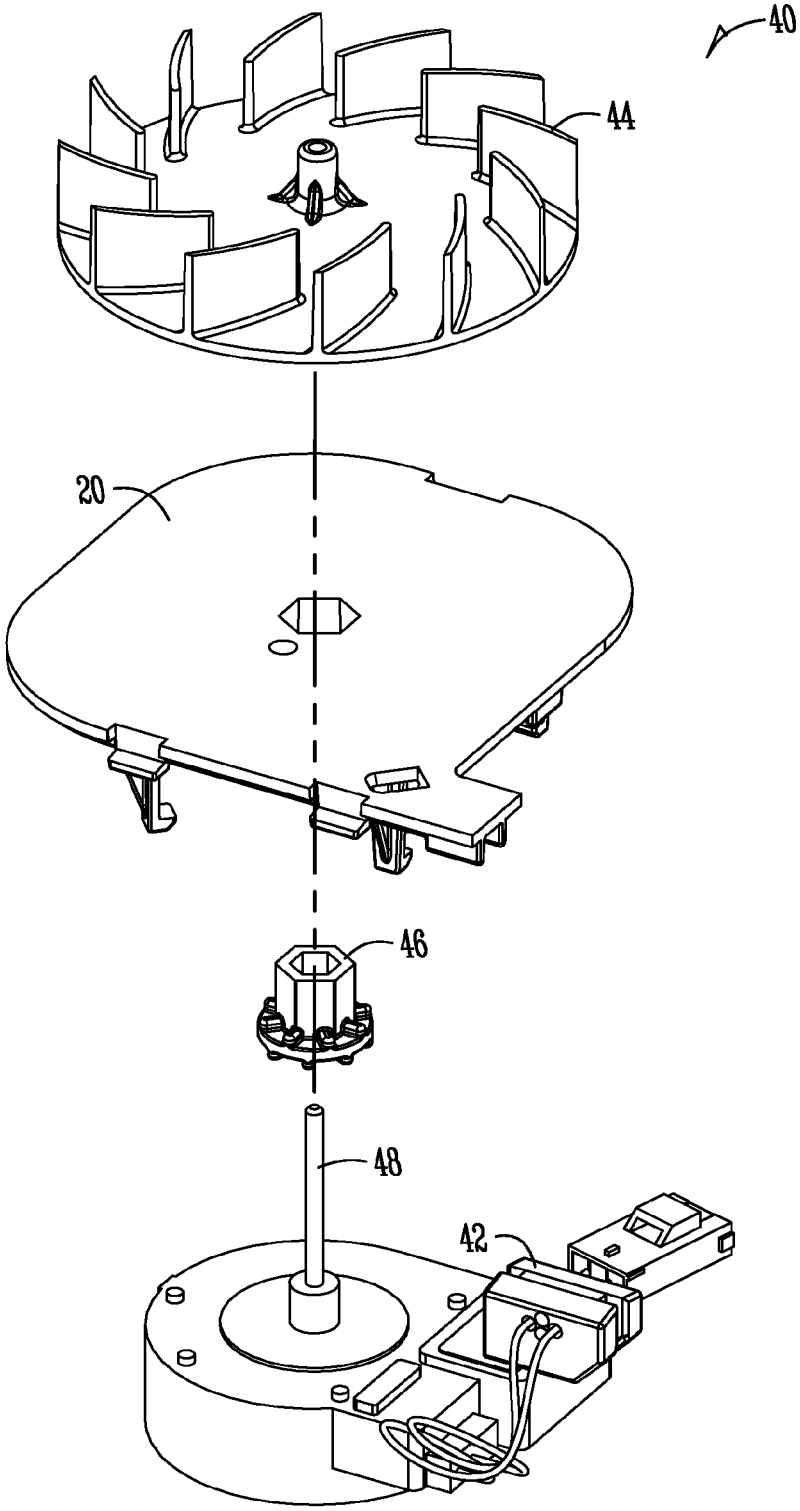
FIG. 6 is an exploded view of the assembly of FIG. 4.

FIG. 6 is an exploded view of the assembly of FIG. 4. As FIG. 6 shows, the components of the assembly 40, consisting of the fan 44, bracket 20, grommet 46, and motor 42, are aligned through an axis. Additionally, no separate fasteners are used to engage the components of the assembly 40.

Figure 7:
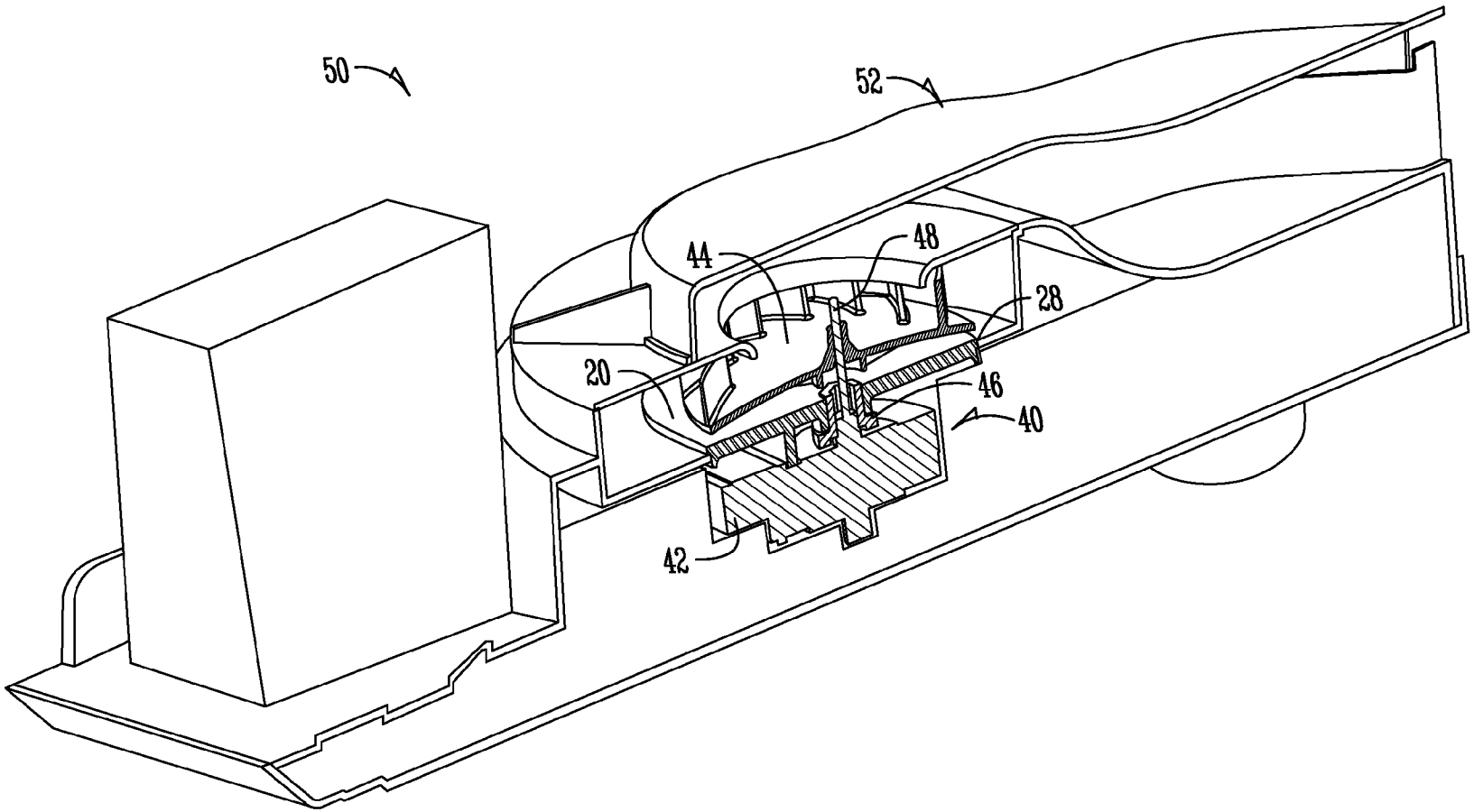
FIG. 7 is a cross-sectional view of one embodiment of an ice box showing the location of the assembly of FIG. 5.

FIG. 7 is a cross sectional view of one embodiment of an ice box 50, which also shows the location of the assembly 40 of FIG. 5. As seen in FIG. 7, an ice box housing 52 encloses the assembly 40 within the ice box 50. Additionally, as seen in FIG. 7, the bracket 20 is secured to the ice box 50 by means of tool removable snap features 28. The bracket 20 may be secured to the ice box by other means, such as, but not limited to, secondary latches.

Also disclosed is a method of manufacturing a refrigerator. A grommet 46 is inserted into a hole 26 of the bracket 20. Next, a motor 42 is pressed towards the first face 22 of the bracket 20 and lined up with the post 30 for correct positioning. The motor 42 is pressed towards the first face 22 to a position where the motor is flush with the first face 22 of the bracket 20, causing the latches 24 to engage the motor in place. The fan 44 is then attached to the second face 23 of the bracket 20, wherein the shaft 48 of the motor 42 is connected to the fan 44. The assembly 40, now containing the fan 44, motor 42, grommet 46, and bracket 20, is then installed in the ice box 50. Securing means 28 located on the bracket 20 are then connected to the ice box 50 to secure the assembly 40 into place. Securing means 28 may consist of secondary latches or tool removable snap features or additional means.

A refrigerator with an ice making compartment including a bracket has been described. The bracket may provide various advantages including ease of use and convenience for a manufacturer of a refrigerator in manufacturing the ice making compartment. Because the bracket consists of one piece and the fan, motor and grommet connect to the bracket without additional securing means, the bracket is easier to put together and secure to the ice box. The low number of pieces allows the assembly to be put together and attached to an ice box in a timely manner. Additionally, noise and vibration are reduced by the use of one grommet used in connecting the shaft from the motor and the fan.

Although specific embodiments are described herein, the present invention contemplates numerous variations, options, and alternatives, including variations in the structure or configuration of the refrigerator, and variations in the type of material used. The present invention is not to be limited to the specific embodiments described herein or combinations of the specific embodiments described.

What is claimed is:

1. A refrigerator, comprising:

a refrigerator cabinet;

a freezer compartment disposed within the refrigerator cabinet;

a fresh food compartment disposed within the refrigerator cabinet;

at least one door providing access to the fresh food compartment;

an ice making compartment in the refrigerator cabinet for making ice;

an assembly associated with the ice making compartment, the assembly comprising a fan and a motor; and a bracket for mounting the assembly, the bracket comprising:

(a) a first face having a plurality of latches extending therefrom, the latches holding the motor in place without the need for separate fasteners, (b) a second face opposite the first face, the second face securing the fan without separate fasteners, and (c) a hole extending from the first face to the second face, a shaft of the motor extending through the hole.

2. The refrigerator of claim 1 wherein the bracket further comprises a post extending from the first face to align and stabilize the motor.

3. The refrigerator of claim 1 wherein the bracket further comprises a grommet inserted through the hole of the bracket to engage the shaft of the motor.

4. The refrigerator of claim 1 wherein each of the latches of the bracket comprise a stem and a lip extending away from the stem and engaging the motor.

5. The refrigerator of claim 1 wherein the ice making compartment being disposed within an insulated ice compartment housing.

6. The refrigerator of claim 5 wherein the bracket is secured to the insulated compartment housing.

7. The refrigerator of claim 6 wherein the bracket is secured to the insulated compartment housing with a plurality of secondary latches located on the bracket.

8. The refrigerator of claim 6 wherein the bracket is secured to the insulated compartment housing with a plurality of tool removable snap features.

9. A method manufacturing a refrigerator, comprising the steps of:

providing a refrigerator cabinet, at least one door for providing access to within the cabinet, an ice making compartment disposed within the cabinet, and a bracket located at the ice making compartment, the bracket having a first face and an opposite second face, the first face having a plurality of latches thereon;

attaching a fan to the second face of the bracket;

positioning a motor adjacent the first face of the bracket;

pressing the motor to a position flush with the first face of the bracket, causing the latches to engage the motor;

connecting a shaft from the motor to the fan; and installing the bracket such that the fan assists in cooling the ice making compartment.

10. The method of claim 9 wherein the bracket further comprises a post for positioning the motor.

11. The method of claim 10 further comprising aligning the motor with the post.

12. The method of claim 9 further comprising installing a grommet onto the shaft for insulating the motor.

13. The method of claim 9 wherein each of the latches comprise a stem and a lip, the lip engaging the motor.

14. The method of claim 9 wherein the bracket further comprises a plurality of secondary latches on the second face.

15. The method of claim 14 wherein the step of installing the bracket comprises engagedly connecting the secondary latches to the ice making compartment.

16. A refrigerator manufactured by the method of claim 9.

17. A refrigerator, comprising:

a refrigerator cabinet;

a freezer compartment disposed within the refrigerator cabinet;

a fresh food compartment disposed within the refrigerator cabinet;

at least one door providing access to the fresh food compartment;

an ice making compartment in the refrigerator cabinet for making ice;

an assembly associated with the ice making compartment, the assembly comprising a fan and a motor;

a bracket for mounting the assembly proximate the ice making compartment, the bracket comprising:

(a) a first face having a plurality of latches extending therefrom, the latches holding the motor in place without the need for separate fasteners, (b) a second face opposite the first face, the second face securing the fan without separate fasteners, (c) a hole extending from the first face to the second face, a shaft of the motor extending through the hole, and (d) a post extending from the first face to align and stabilize the motor; and a grommet inserted into the hole of the bracket, wherein the bracket engages the shaft of the motor and provides an airtight seal between the motor shaft and the hole.

18. The refrigerator of claim 17 wherein the bracket further comprises a plurality of secondary latches that engagedly connect with an ice box housing, which encloses the ice making compartment.

19. An ice box for use in a refrigerator, comprising:

an ice making compartment for making ice;

an assembly disposed within the ice box, the assembly comprising a fan and a motor; and a bracket for mounting the fan and motor assembly in the ice box, the bracket comprising:

(a) a first face having a plurality of latches extending therefrom, the latches adapted to hold the motor in place without the need for separate fasteners, (b) a second face opposite the first face, the second face adapted to mount a fan without separate fasteners, (c) a hole extending from the first face to the second face adapted to receive a shaft from the motor.

20. The ice box of claim 19 wherein the bracket further comprises a post extending from the first face, the post aligning and stabilizing the motor.

21. The ice box of claim 19 wherein the bracket further comprises a grommet inserted into the hole of the bracket, the grommet providing an airtight seal between the motor shaft and the hole.

22. The ice box of claim 19 wherein each of the latches of the bracket comprise a stem and a lip extending away from the stem, the lip engaging the motor.

23. The ice box of claim 19 wherein the bracket is secured to the ice box.

24. The ice box of claim 23 wherein the bracket is secured to the ice box with a plurality of secondary latches located on the first face of the bracket.

25. The ice box of claim 23 wherein the bracket is secured to the ice box with a plurality of tool removable snap features.

* * * * *